US009353997B2

(12) United States Patent
Kim et al.

(10) Patent No.: US 9,353,997 B2
(45) Date of Patent: May 31, 2016

(54) HEAT EXCHANGER

(71) Applicant: LG Electronics Inc., Seoul (KR)

(72) Inventors: Sehyeon Kim, Seoul (KR); Eungyul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 249 days.

(21) Appl. No.: 13/871,575

(22) Filed: Apr. 26, 2013

(65) Prior Publication Data

US 2013/0284414 A1 Oct. 31, 2013

(30) Foreign Application Priority Data

Apr. 26, 2012 (KR) ..... 10-2012-0044139

(51) Int. Cl.

| | |
|---|---|
| ***F28F 1/12*** | (2006.01) |
| ***F28F 1/32*** | (2006.01) |
| ***F28F 17/00*** | (2006.01) |
| *F28D 1/053* | (2006.01) |

(52) U.S. Cl.

CPC ... *F28F 1/12* (2013.01); *F28F 1/32* (2013.01); *F28F 17/005* (2013.01); *F28D 1/05366* (2013.01); *F28F 2260/02* (2013.01); *F28F 2265/06* (2013.01); *F28F 2265/22* (2013.01)

(58) Field of Classification Search

CPC ..... F28F 7/005; F28F 1/12; F28F 1/325; F28F 2265/06; F28F 1/32; F28F 2265/22; F28F 2260/02; F28D 1/05366; F28D 1/05316

USPC ..... 165/151, 175, 176, 71

See application file for complete search history.

(56) References Cited

U.S. PATENT DOCUMENTS

| | | | | |
|---|---|---|---|---|
| 2,689,465 | A * | 9/1954 | McNeely | 62/434 |
| 3,902,551 | A | 9/1975 | Lim et al. | |
| 4,266,604 | A * | 5/1981 | Sumikawa et al. | 165/176 |
| 5,042,576 | A | 8/1991 | Broadbent | |
| 5,168,923 | A * | 12/1992 | Sacks | 165/151 |
| 5,207,270 | A * | 5/1993 | Yokoyama et al. | 165/151 |
| 6,932,153 | B2 * | 8/2005 | Ko | F28D 1/0535 165/110 |
| 7,182,127 | B2 * | 2/2007 | Oh et al. | 165/151 |
| 2006/0005956 | A1 * | 1/2006 | Kester | 165/151 |
| 2007/0028626 | A1 * | 2/2007 | Chen | 62/6 |
| 2007/0151716 | A1 | 7/2007 | Lee et al. | |
| 2009/0308585 | A1 * | 12/2009 | Chen et al. | 165/185 |

FOREIGN PATENT DOCUMENTS

| | | | |
|---|---|---|---|
| CN | 1153270 | A | 7/1997 |
| CN | 1172238 | A | 2/1998 |
| CN | 1184245 | A | 6/1998 |
| EP | 0789216 | A2 | 8/1997 |
| EP | 0845649 | A2 | 6/1998 |

* cited by examiner

*Primary Examiner* — Tho V Duong
(74) *Attorney, Agent, or Firm* — Dentons US LLP

(57) ABSTRACT

Provided is a heat exchanger, which includes a plurality of flat tubes in which refrigerant flows, a fin including tube couplers in which the flat tubes are inserted, wherein the refrigerant exchanges heat with a fluid through the fin, and a header coupled to at least one side portion of the flat tubes and distributing the refrigerant to the flat tubes. The fin includes a first fin coupled to a part of the flat tubes, the part of the flat tubes constituting a first row, and a second fin provided on a side portion of the first fin and coupled to another part of the flat tubes, the another part of the flat tubes constituting a second row.

11 Claims, 10 Drawing Sheets

HEAT EXCHANGER

CROSS-REFERENCE TO RELATED APPLICATIONS

The present application claims priority under 35 U.S.C. 119 and 35 U.S.C. 365 to Korean Patent Application No. 10-2012-0044139 (filed on Apr. 26, 2012), which is hereby incorporated by reference in its entirety.

BACKGROUND

The present disclosure relates to a heat exchanger.

In general, a heat exchanger constitutes a heat exchange cycle and functions as a condenser or an evaporator. Refrigerant flowing in the heat exchanger exchanges heat with an outer fluid. For example, a heat exchanger may be used in an air conditioner and function as a condenser for condensing refrigerant or an evaporator for evaporating refrigerant, according to a refrigerant cycle.

Such heat exchangers are classified into fin-and-tube type heat exchangers and micro-channel type heat exchangers, according to the shapes thereof. A fin-and-tube type heat exchanger includes a plurality of fins and a cylindrical or cylindrical-like tube passing through the fins. A micro-channel type heat exchanger includes a plurality of flat tubes in which refrigerant flows, and a fin disposed between the flat tubes. Both the fin-and-tube type heat exchanger and the micro-channel type heat exchanger exchange heat between an outer fluid and refrigerant flowing within the tube or the flat tube, and the fin increase a heat exchange area between the outer fluid and the refrigerant flowing within the tube or the flat tube.

However, such typical heat exchangers have the following limitations.

First, the tube of a fin-and-tube type heat exchanger passes through the fins. Thus, even when condensate water generated while the fin-and-tube type heat exchanger operates as an evaporator flows down along the fins, or is frozen onto the outer surface of the tube or the fins, the heat exchanger can efficiently remove the condensate water.

However, fin-and-tube type heat exchangers include only a single refrigerant passage in a tube, and a heat exchange area between the tube and a fin is not large. Thus, heat exchange efficiency of the refrigerant is substantially low.

On the contrary, since micro-channel type heat exchangers include a plurality of refrigerant passages within a flat tube, and a heat exchange area between the flat tube and a fin is large. Thus, micro-channel type heat exchangers are higher in heat exchange efficiency of refrigerant than fin-and-tube type heat exchangers.

However, a fin of micro-channel type heat exchangers is disposed between flat tubes that are spaced apart from each other. Hence, condensate water generated at micro-channel type heat exchangers may not be discharged from between the flat tubes and thus be frozen. In particular, this issue may be critical when micro-channel type heat exchangers are used as evaporators. In this case, heat exchange efficiency of refrigerant may be decreased.

SUMMARY

Embodiments provide a heat exchanger that efficiently discharges condensate water and improves heat exchange efficiency.

In one embodiment, a heat exchanger includes: a plurality of flat tubes in which refrigerant flows; a fin including tube couplers in which the flat tubes are inserted, wherein the refrigerant exchanges heat with a fluid through the fin; and a header coupled to at least one side portion of the flat tubes and distributing the refrigerant to the flat tubes, wherein the fin includes: a first fin coupled to a part of the flat tubes, the part of the flat tubes constituting a first row; and a second fin provided on a side portion of the first fin and coupled to another part of the flat tubes, the another part of the flat tubes constituting a second row.

In another embodiment, a heat exchanger includes: a plurality of headers; a plurality of flat tubes disposed between the headers, wherein refrigerant flows in the flat tubes; a first fin including a first tube coupler in which one of the flat tubes is inserted; a second fin including a second tube coupler in which another one of the flat tubes is inserted; and a drain groove recessed between the first and second fins to guide a discharge of condensate water formed on the flat tube.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described in detail with reference to the accompanying drawings. The disclosure may, however, be embodied in many different forms and should not be construed as being limited to the embodiments set forth herein; rather, that alternate embodiments falling within the spirit and scope of the present disclosure will fully convey the concept of the disclosure to those skilled in the art.

Figure 1:
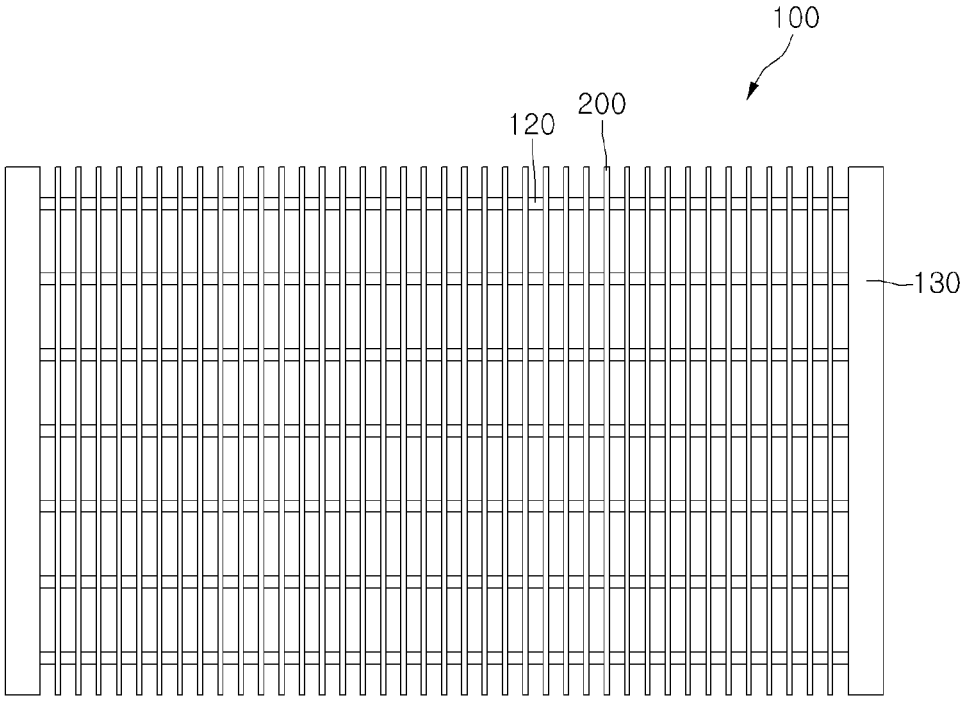
FIG. 1 is a schematic view illustrating a configuration of a heat exchanger according to a first embodiment.

FIG. 1 is a schematic view illustrating a configuration of a heat exchanger according to a first embodiment.

Referring to FIG. 1, a heat exchanger 100 according to the current embodiment includes: a plurality of fins 200 having a flat plate shape; a plurality of refrigerant tubes 120 passing through at least one portion of the fins 200; and a plurality of headers 130 disposed at both ends of each of the refrigerant tubes 120 to connect the ends of the refrigerant tubes 120 at each side to one another. The refrigerant tube 120 may be "a flat tube" including a plurality of passages therein.

The refrigerant tubes 120 are spaced apart from one another in an up-and-down direction (or in a vertical direction) and pass through the fins 200 that are horizontally spaced apart from one another. Although the headers 130 illustrated in FIG. 1 are exemplified as "vertical headers" that extend in the up-and-down direction, the headers 130 may be "horizontal headers" that extend in a left-and-right direction (or in a horizontal direction).

When the headers 130 are horizontal headers, a plurality of refrigerant tubes are horizontally spaced apart from one another and pass through a plurality of fins that are vertically spaced apart from one another. Hereinafter, descriptions will be made with respect to refrigerant tubes and fins coupled to vertical headers as illustrated in FIG. 1.

The fins 200 have a rectangular flat plate shape with a predetermined length. The fins 200 substantially increase a heat exchange area between an external fluid and refrigerant flowing through the tubes 120. The fins 200 are spaced a predetermined distance from one another such that each of both side surfaces of the fins 200 faces a side surface of a neighboring one of the fins 200.

The headers 130 are connected to both the ends of the tubes 120, respectively. The headers 130 have a space in which refrigerant flows, and distribute refrigerant to the tubes 120. To this end, a plurality of baffles (not shown) for distributing refrigerant to the tubes 120 may be disposed within the headers 130.

Figure 2:
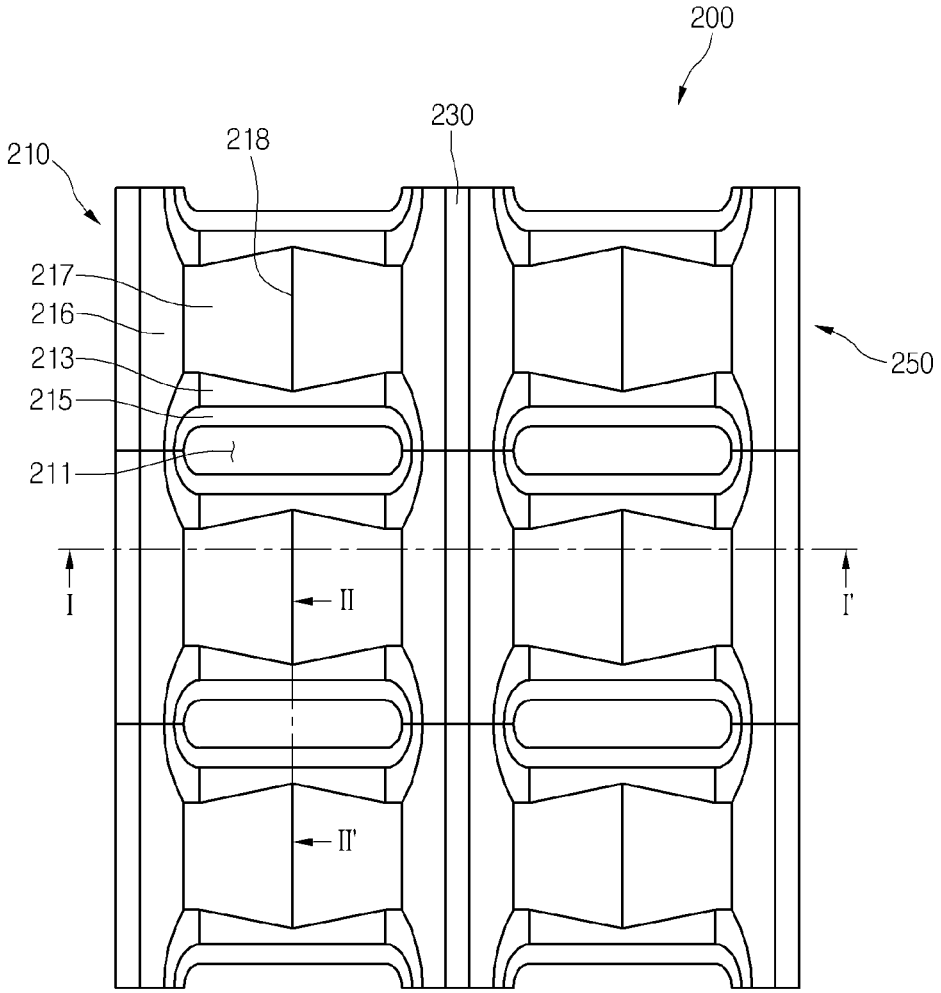
FIG. 2 is a schematic view illustrating a configuration of a fin according to the first embodiment.
Figure 3:
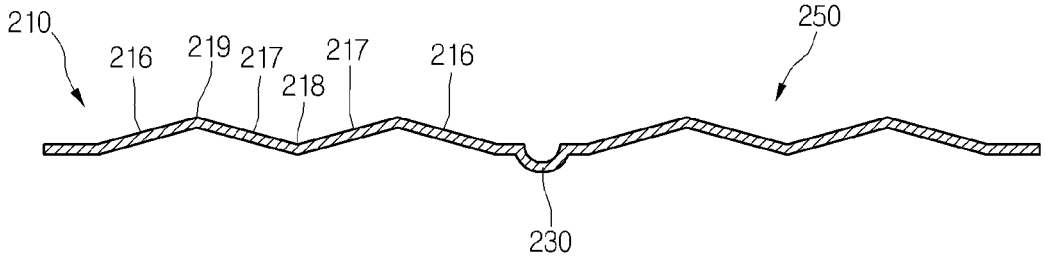
FIG. 3 is a cross-sectional view taken along line I-I' of FIG. 2.
Figure 4:
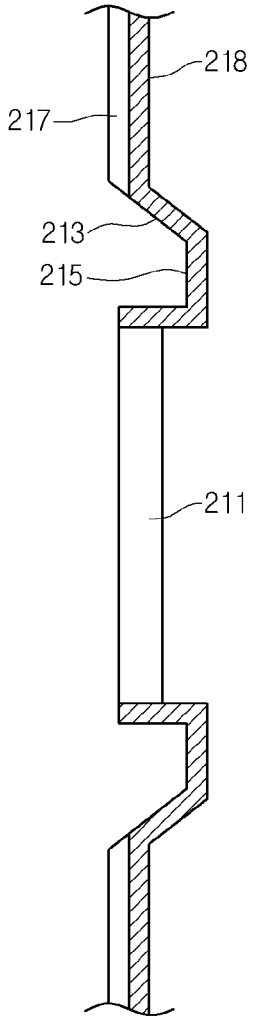
FIG. 4 is a cross-sectional view taken along line II-II' of FIG. 2.
Figure 5:
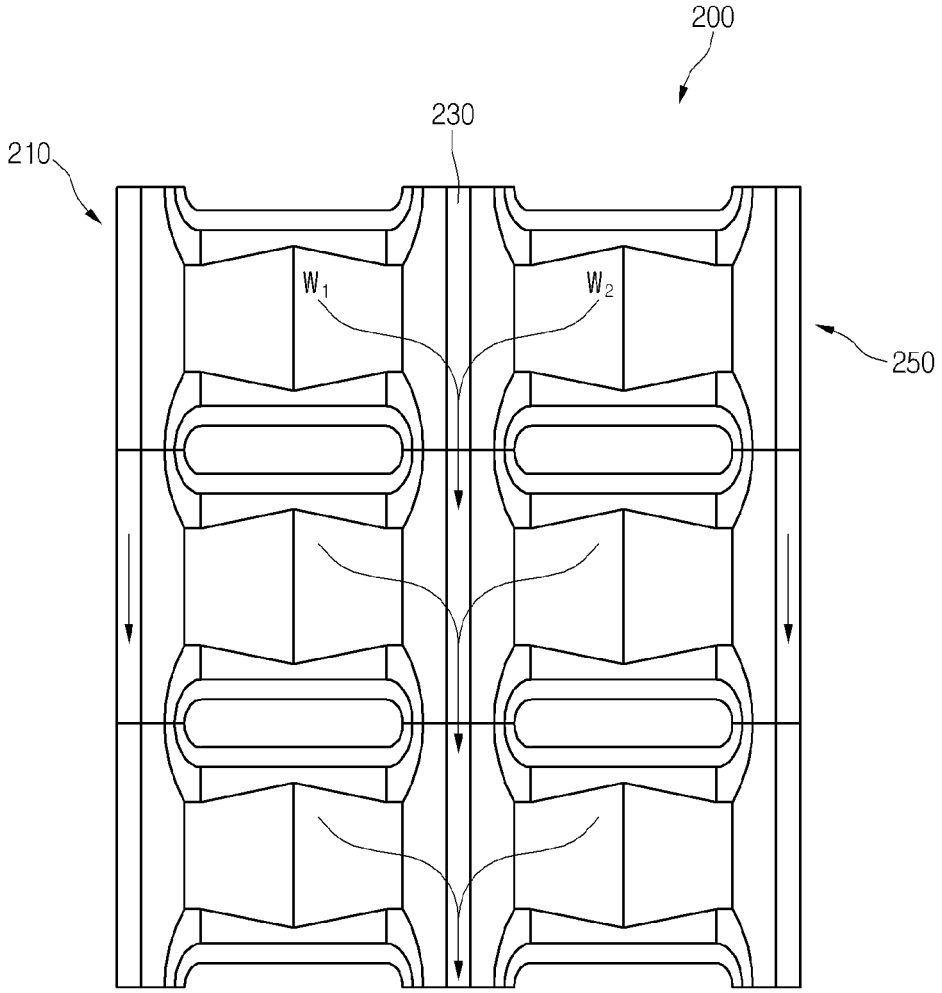
FIG. 5 is a schematic view illustrating a state in which condensate water is discharged from a fin according to the first embodiment.

FIG. 2 is a schematic view illustrating a configuration of a fin according to the first embodiment. FIG. 3 is a cross-sectional view taken along line I-I' of FIG. 2. FIG. 4 is a cross-sectional view taken along line II-II' of FIG. 2. FIG. 5 is a schematic view illustrating a state in which condensate water is discharged from a fin according to the first embodiment.

Referring to FIGS. 2 to 4, a fin 200 according to the first embodiment includes a plurality of fins 210 and 250 which are coupled to each other. In particular, the fin 200 includes: a first fin 210 having a plurality of tube couplers 211; a second fin 250 coupled to a side portion of the first fin 210; and a drain part 230 disposed between the first and second fins 210 and 250.

The first fin 210 constitutes a vertical row, and the second fin 250 constitutes the other vertical row at a side of the first fin 210. Under this configuration of the first and second fins 210 and 250, the refrigerant tubes 120 coupled to the first and second fins 210 and 250 may be arrayed in two rows, e.g., in first and second rows.

As such, a plurality of fins are used for a heat exchange of refrigerant tubes. Thus, a heat exchange area for refrigerant is increased to improve heat exchange efficiency. Although two coupled fins are illustrated in the drawings, three or more coupled fins may be provided.

The first and second fins 210 and 250 may be symmetrical to each other with respect to the drain part 230. That is, the first and second fins 210 and 250 are the same in configuration. Thus, the first fin 210 will now be representatively described.

The first fin 210 is provided with the tube couplers 211. The tube couplers 211 function as openings through which the refrigerant tubes 120 pass. The tube couplers 211 are spaced apart from one another in the longitudinal direction (or in the vertical direction) of the first fin 210 by a predetermined distance, substantially by a distance between the refrigerant tubes 120.

The tube couplers 211 of the first fin 210 and tube couplers of the second fin 250 may be arrayed side by side or in parallel to each another. Thus, the tube couplers 211 of the first fin 210 may be symmetrical to the tube couplers of the second fin 250 with respect to the drain part 230.

Guide parts for guiding discharges of condensate water are disposed around the tube couplers 211 or between the tube couplers 211.

The guide part includes a recess part 215 disposed outside of the tube coupler 211. The recess part 215 extends outward around the tube coupler 211 and is downwardly recessed a predetermined depth. Here, the terms "downwardly" and "upwardly" are defined on the basis of FIG. 3 and the orientations thereof are also used in the following descriptions.

The guide part includes a first slope part 213 that is disposed outside of the recess part 215 to surround the recess part 215 and that is downwardly inclined toward the recess part 215. The first slope part 213 extends outward around the recess part 215.

Since the first slope part 213 is inclined toward the recess part 215, condensate water located at the upper side of the recess part 215 may be introduced into the recess part 215 through the first slope part 213, and condensate water located in the recess part 215 may be moved to the lower side thereof through the first slope part 213.

The guide part includes second slope parts 216 and a third slope part 217 which are disposed between the tube couplers 211. The second slope part 216 is upwardly inclined from a side end of the first fin 210. The third slope part 217 is downwardly inclined from ends of the second slope parts 216.

A peak part 219 is defined between the second slope parts 216 and the third slope part 217. The peak parts 219 are apiculus parts as transitions from the second slope parts 216 to the third slope part 217.

An end of the third slope part 217, that is, the lowest portion thereof is provided with a bent part 218. That is, the second slope part 216 and the third slope part 217 extend toward a side of the bent part 218. Also, the second slope part 216 and the third slope part 217 extend toward another side of the bent part 218. That is, the second slope parts 216 and the third slope part 217 are symmetrically disposed with respect to the bent part 218.

Condensate water may be guided to a central part of the first fin 210 (i.e., the bent part 218) or both side ends of the first fin 210 along slope structures of the second and third slope parts 216 and 217. While a fluid flows along the fin 200, heat exchange efficiency thereof can be improved since the second and third slope parts 216 and 217 increase a heat contact area.

The drain part 230 is disposed between the first and second fins 210 and 250. In particular, the drain part 230 is recessed downwardly between the second slope part 216 of the first fin 210 and a second slope part (no reference numeral) of the second fin 250 which is symmetrical to the second slope part 216. A recessed portion (a guide groove) of the drain part 230 functions as a discharge passage for guiding a flow of condensate water. The drain part 230 may be referred to as "a discharge groove", "a drain groove", or "a drain recess part".

At least one portion of condensate water guided by slopes of the first or second fin 210 or 250 may be introduced into the drain part 230 and be discharged to the lower side.

Referring to FIG. 5, while condensate water formed on an outer surface of the fin 200 is guided along the guide parts of the first and second fins 210 and 250, that is, along inclined surfaces thereof, the condensate water may flow to the lower side along both sides of the first fin 210 and both sides of the second fin 250.

Condensate water guided to a side of the first fin 210 (the right side thereof on the basis of FIG. 5) and a side of the second fin 250 (the left side thereof on the basis of FIG. 5) is introduced into the drain part 230 (refer to arrows W1 and W2), and flow along the guide groove of the drain part 230 to the lower side.

As such, fins coupled to the refrigerant tube 120 to perform a heat exchange are arrayed in a plurality of rows, thus increasing a heat exchange area of the refrigerant tube 120. In addition, since a drain part for guiding discharges of condensate water is disposed between a plurality of fins, the condensate water is efficiently discharged, thus preventing the condensate water from being frozen on an outer surface of a fin or a refrigerant tube.

Hereinafter, descriptions will be made according to second and third embodiments. Here, different parts between the first to third embodiments will be described principally, and a description of the same parts thereof will be omitted, and like reference numerals denote like elements throughout.

Figure 6:
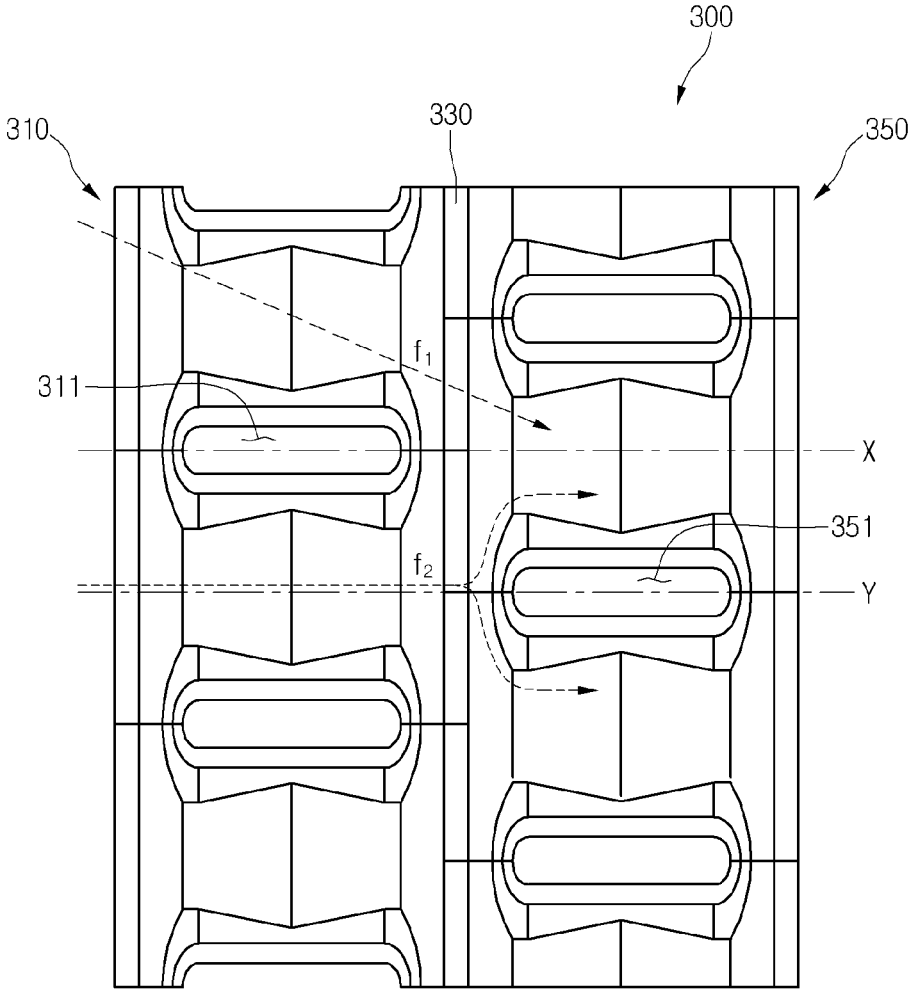
FIG. 6 is a schematic view illustrating a configuration of a fin according to a second embodiment.
Figure 7:
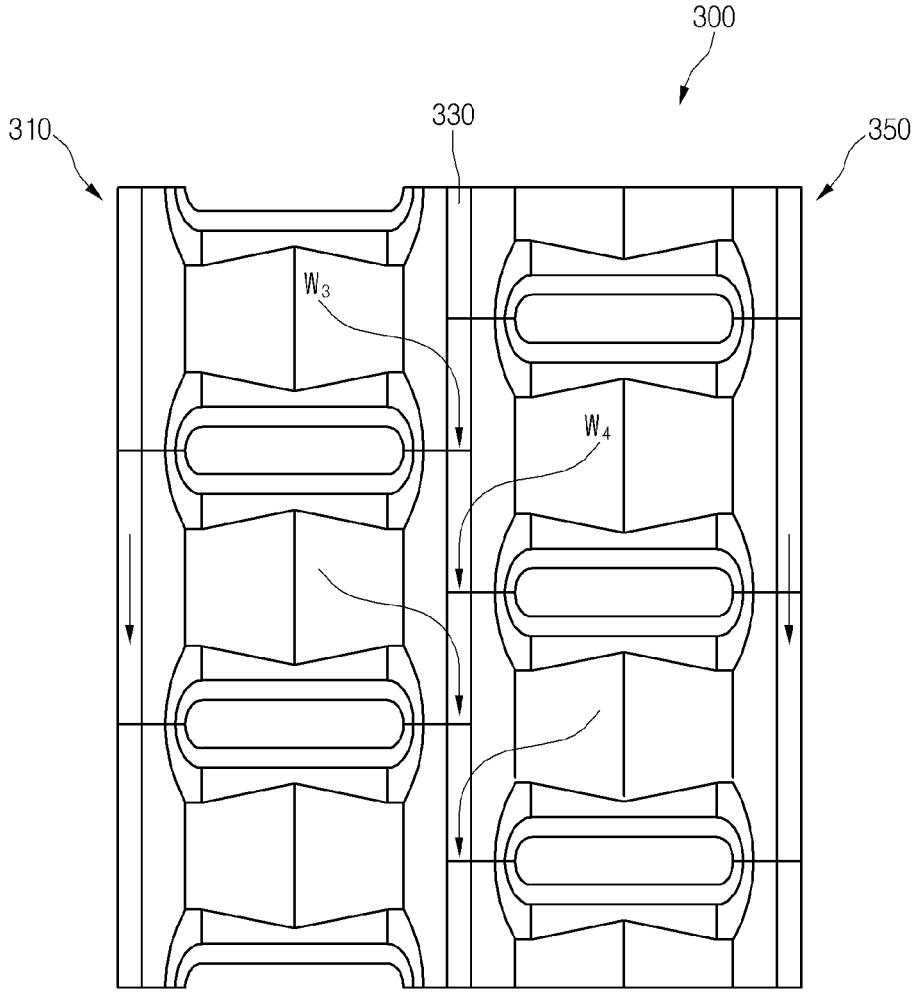
FIG. 7 is a schematic view illustrating a state in which condensate water is discharged from a fin according to the second embodiment.

FIG. 6 is a schematic view illustrating a configuration of a fin according to the second embodiment. FIG. 7 is a schematic view illustrating a state in which condensate water is discharged from a fin according to the second embodiment.

Referring to FIGS. 6 and 7, a fin 300 according to the second embodiment includes: a first fin 310 having a plurality of first tube couplers 311; a second fin 350 coupled to a side portion of the first fin 310 and having a plurality of second tube couplers 351; and a drain part 330 disposed between the first and second fins 310 and 350.

The first tube couplers 311 are vertically spaced apart from one another. The second tube couplers 351 are vertically spaced apart from one another and are disposed at heights different from those of the first tube couplers 311, so that the second tube couplers 351 and the first tube couplers 311 are arrayed in a crisscross pattern. That is, the first tube couplers 311 and the second tube couplers 351 are alternately arrayed in the vertical direction.

In particular, an imaginary horizontal extension line X, passing through the center of the first tube coupler 311, also passes through a region between the second tube couplers 351, that is, through a guide part having slopes. In addition, an imaginary horizontal extension line Y, passing through the center of the second tube coupler 351, also passes through a region between the first tube couplers 311, that is, through a guide part having slopes.

The first tube couplers 311 and the second tube couplers 351 are alternately arrayed, whereby the refrigerant tubes 120 coupled to the first and second tube couplers 311 and 351 are alternately arrayed. For example, when refrigerant tubes are arrayed in two rows, the refrigerant tubes arrayed in the first row may be disposed alternately with the refrigerant tubes arrayed in the second row, in the vertical direction.

Since the first tube couplers 311 and the second tube couplers 351 are alternately arrayed, a moving distance of a fluid flowing from the first fin 310 to the second fin 350 is increased.

That is, a fluid can obliquely flow via a space between the first tube couplers 311 and a space between the second tube couplers 351 (refer to an arrow f1). A fluid passing through a side of the first fin 310 may diverge at the second tube coupler 351 (refer to arrows f2). As such, a moving distance of a fluid is increased, thereby increasing a heat contact area and improving heat exchange efficiency.

At least one portion (W3) of condensate water flowing around the first tube couplers 311, at least one portion (W4) of condensate water flowing around the second tube couplers 351 may be introduced into the drain part 330 and be discharged to the lower side. Thus, condensate water can be efficiently discharged and be prevented from being frozen on an outer surface of a fin.

Figure 8:
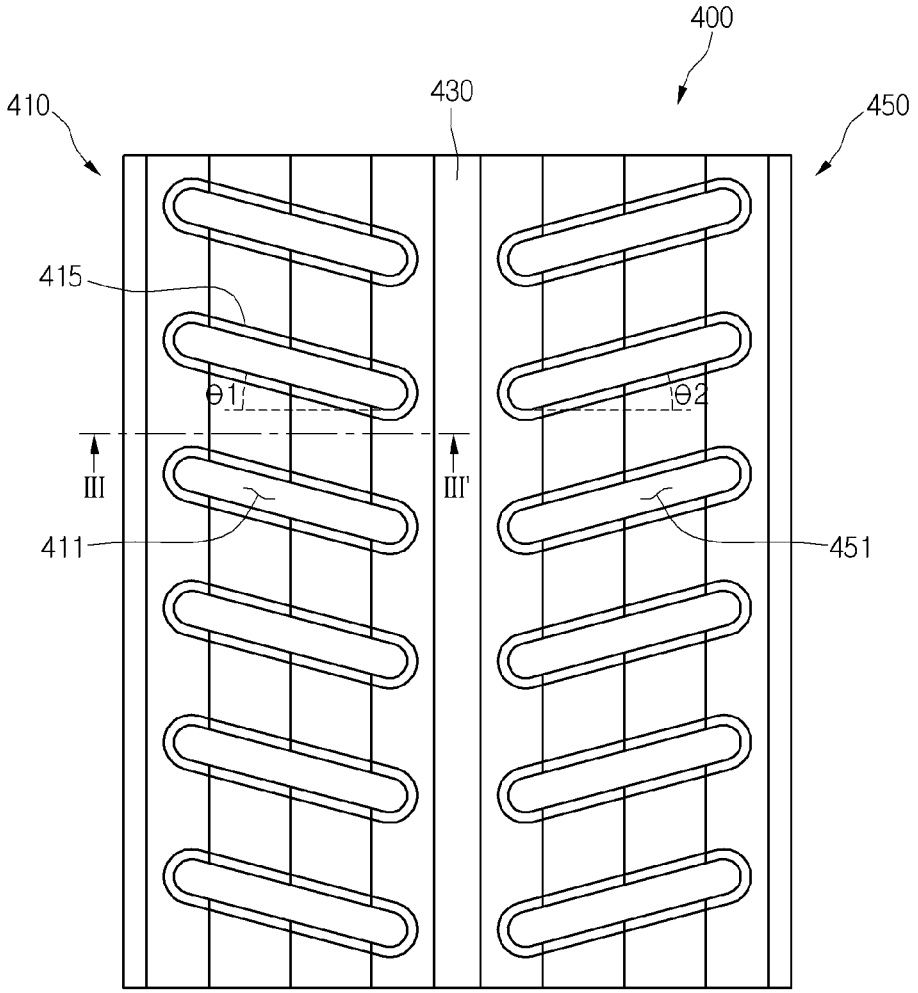
FIG. 8 is a schematic view illustrating a configuration of a fin according to a third embodiment.
Figure 9:
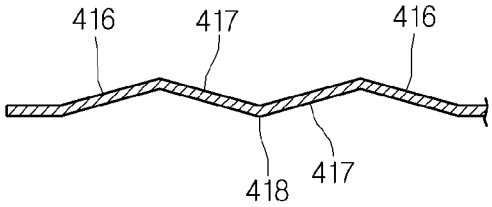
FIG. 9 is a cross-sectional view taken along line III-III' of FIG. 8.
Figure 10:
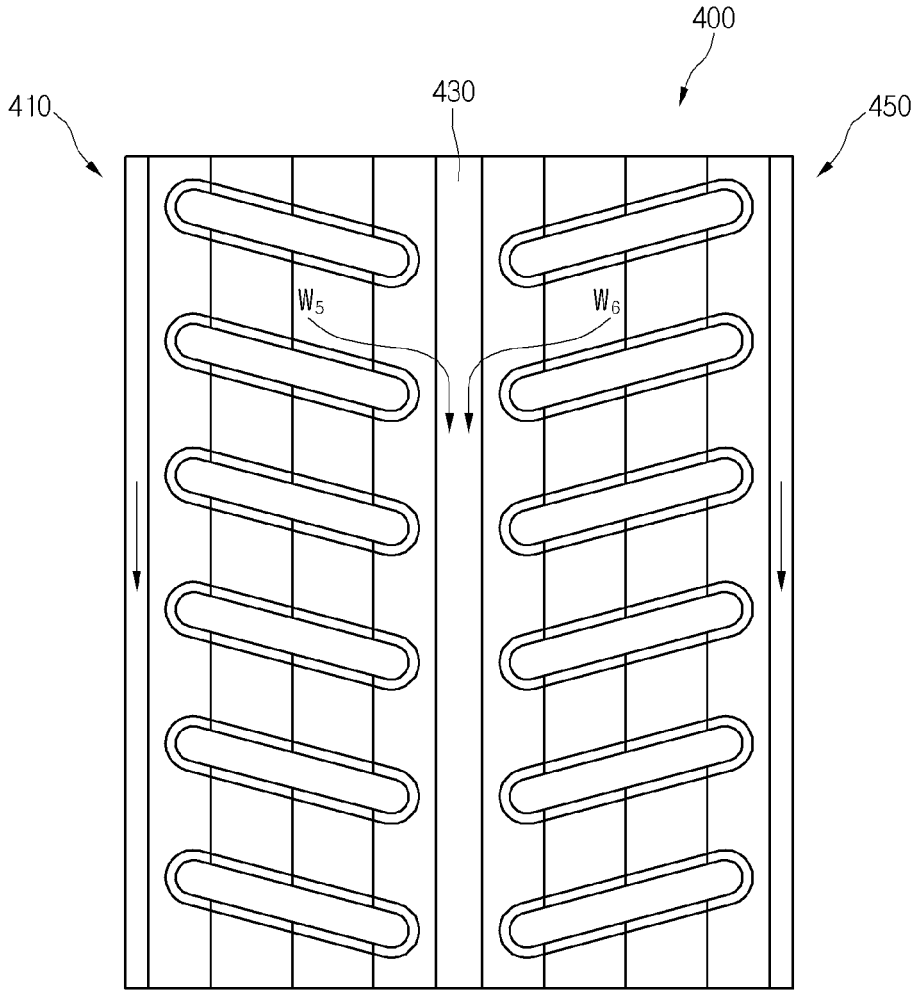
FIG. 10 is a schematic view illustrating a state in which condensate water is discharged from a fin according to the third embodiment.

FIG. 8 is a schematic view illustrating a configuration of a fin according to the third embodiment. FIG. 9 is a cross-sectional view taken along line III-III' of FIG. 8. FIG. 10 is a schematic view illustrating a state in which condensate water is discharged from a fin according to the third embodiment.

Referring to FIGS. 8 to 10, a fin 400 according to the third embodiment includes: a first fin 410 having a plurality of first tube couplers 411 inclined in a predetermined direction; a second fin 450 coupled to the first fin 410 and having a plurality of second tube couplers 451 inclined in a predetermined direction; and a drain part 430 disposed between the first and second fins 410 and 450.

The first tube couplers 411 may be inclined to the lower side toward the drain part 430 and be parallel to one another. In other words, a side end of the first tube couplers 411 connected to the drain part 430 extends to the outside at a first set angle θ1 from the horizontal direction. The first set angle θ1 is greater than about 0°.

The second tube couplers 451 may be inclined to the lower side toward the drain part 430 and be parallel to one another. In other words, a side end of the second tube couplers 451 connected to the drain part 430 extends to the outside at a second set angle θ2 from the horizontal direction. The second set angle θ2 is greater than about 0°.

The first and second set angles θ1 and θ2 may be the same, and the first fin 410 may be symmetrical to the second fin 450 with respect to the drain part 430. That is, the first tube coupler 411 and the second tube coupler 451 extend symmetrically to each other toward the drain part 430.

The first tube coupler and the second tube coupler of a heat exchanger according to the current embodiment extend symmetrically to each other toward the drain part.

The first fin 410 includes guide parts that guide condensate water flowing around the first tube couplers 411, to the drain part 430. The guide part includes a recess part 415 that extends outward along the peripheral surface of the first tube coupler 411 and that is recessed a predetermined depth.

The guide part includes: a second slope part 416 inclined upwardly from a side end of the first fin 410; a third slope part 417 inclined downwardly from the second slope part 416; and a bent part 418 constituting the lower end of the third slope part 417.

The second slope parts 416 are disposed symmetrically to the third slope parts 417 with respect to the bent part 418.

Referring to FIG. 10, condensate water flowing around the first tube coupler 411 is guided to the drain part 430 along the first tube coupler 411 inclined to the lower side toward the drain part 430 (refer to an arrow W5). Condensate water flowing around the second tube coupler 451 is guided to the drain part 430 along the second tube coupler 451 inclined to the lower side toward the drain part 430 (refer to an arrow W6).

As such, since the first and second tube couplers 411 and 451 are inclined to the lower side, condensate water can be efficiently introduced into the drain part 430 and be discharged to the lower side. As a result, condensate water can be prevented from being frozen on the refrigerant tubes 120 or the 400.

According to the above embodiments, two or more rows of refrigerant tubes are inserted in a fin for a heat exchange between refrigerant and a fluid, so as to increase a heat exchange area, thus improving heat exchange efficiency of the refrigerant.

In addition, a plurality of fins are coupled, and a drain part is disposed between the coupled fins to guide discharges of condensate water, thus preventing the condensate water from being frozen on an outer surface of a fin or a refrigerant tube.

In addition, since tube couplers (opening parts) formed on a fin may be alternately arrayed in a vertical direction, moving performance of a fluid passing through a heat exchanger can be improved in a moving direction thereof, and a heat transfer area thereof can be increased.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger comprising:

a plurality of tubes in which refrigerant flows;

a fin comprising a plurality of tube couplers in which each of the plurality of tubes are inserted, respectively, to allow the refrigerant to exchange heat with a fluid, the plurality of tube couplers being vertically spaced apart front one another, the fin comprising:

a first fin coupled to a first division of the plurality of tubes, the first division constituting a first row; and a second fin provided on a side portion of the first fin and coupled to a second division of the plurality of tubes, the second division constituting a second row, a header coupled to a side portion of the plurality of tubes in order to distribute the refrigerant to the tubes;

a drain part to guide discharges of condensate water flowing on the first and second fins; and a guide part provided at least at one of the first fin and the second fin and configured to guide condensate water flowing on a side portion of the first fin or the second fin, to the drain part, the guide part comprising:

a first slope part disposed between the tube couplers and inclined upwardly from a side end of the first and the second fins, respectively; and a second slope part inclined downwardly from the first slope part, wherein the drain part is disposed between the side end of the first fin and the side end of the second find and comprises a guide groove recessed downwardly from the first slope part of the first fin and the first slope part of the second fin, wherein the plurality of tubes extends from the header horizontally and the guide groove extends from an upper part of the fin towards a lower part of the fin longitudinally.

2. The heat exchanger according to claim 1, wherein the first and the second fins are symmetrical to each other with respect to the drain part.

3. The heat exchanger according to claim 1, wherein a plurality of first tube couplers provided in the first fin and a plurality of second tube couplers provided in the second fin are arrayed side by side or in parallel to each other.

4. The heat exchanger according to claim 1, wherein the tube couplers are vertically spaced apart from one another, and wherein a plurality of first tube couplers provided in the first fin are arrayed alternately with a plurality of second tube couplers provided in the second fin, in a vertical direction.

5. The heat exchanger according to claim 4, wherein a horizontal center line passing through a center of one of the plurality of first tube couplers passes through a region between the two of the plurality of second tube couplers.

6. The heat exchanger according to claim 1, wherein the tube couplers are vertically spaced apart from one another and are inclined to a lower side toward the drain part.

7. The heat exchanger according to claim 6, wherein the tube couplers provided in the first fin and the tube couplers provided in the second fin are symmetrical to each another and are oriented to the drain part.

8. The heat exchanger according to claim 1, wherein the guide part comprises:

a recess part extending outward around at least one of the plurality of tube couplers and recessed a set depth; and a third slope part inclined downwardly to the recess part.

9. The heat exchanger according to claim 3, wherein the plurality of first tube couplers are disposed symmetrically to the plurality of second tube couplers with respect to the guide groove.

10. The heat exchanger according to claim 3, wherein each of the plurality of first tube couplers are disposed at the same heights as a corresponding one of the plurality of second tube couplers.

11. The heat exchanger according to claim 1, wherein the guide groove is further recessed from lower ends of the first slope part of the first and second fins.

* * * * *